United States Patent [19]

Roehrich

[11] 4,031,691

[45] June 28, 1977

[54] DEVICE FOR REINSERTING THE BROKEN YARN IN AN OPEN END SPINNING UNIT

[75] Inventor: Christian Roehrich, Chaillevette, France

[73] Assignee: Nuova San Giorgio S.p.A., Genoa-Sestri, Italy

[22] Filed: Aug. 13, 1976

[21] Appl. No.: 714,114

[30] Foreign Application Priority Data

Aug. 20, 1975 Switzerland ..... 10807/75
Nov. 28, 1975 Switzerland ..... 15462/75

[52] U.S. Cl. ..... 57/34 R; 57/58.95
[51] Int. Cl.[2] ..... D01H 15/00; D01H 1/12
[58] Field of Search ..... 57/34 R, 58.89–58.95, 57/78–81

[56] References Cited

UNITED STATES PATENTS

| | | | |
|---|---|---|---|
| 3,455,095 | 7/1969 | Makeham et al. | 57/34 R |
| 3,695,017 | 10/1972 | Hori et al. | 57/34 R |
| 3,803,823 | 4/1974 | Niestroj et al. | 57/34 R |
| 3,810,352 | 5/1974 | Miyazaki et al. | 57/34 R |
| 3,821,878 | 7/1974 | Parsons | 57/34 R |
| 3,925,975 | 12/1975 | Stahlecker et al. | 57/34 R |
| 3,945,183 | 3/1976 | Landwehrkamp et al. | 57/34 R |
| 3,962,855 | 6/1976 | Stahlecker | 57/34 R |
| 3,987,610 | 10/1976 | Stahlecker et al. | 57/34 R |

*Primary Examiner*—John Petrakes

[57] ABSTRACT

A device for reinserting the broken yarn in an open end spinning unit, comprising a yarn gripping element, attached to an endless belt passing in front of a yarn gripping position on the winding up bobbin and a device for reinserting the broken yarn in the spinning unit; control means act on the belt to move the yarn gripping member from the gripping position to the reinserting position in the spinning unit and then stopping it at least at a location of the path of the endless belt.

17 Claims, 13 Drawing Figures

DEVICE FOR REINSERTING THE BROKEN YARN IN AN OPEN END SPINNING UNIT

This invention relates to a device for reinserting the yarn automatically in the spinning chamber of an open end type of spinning unit.

As well known, when the yarn withdrawn from an open end type of spinning unit breaks, it is necessary to retrieve the yarn end, extracting it from the bobbin, remove therefrom some length of the yarn in order to avoid further risks of breakage, and reinsert the yarn in the spinning unit. In spinning units of said design, the rotation of the spinning rotor develops a slight vacuum in the yarn withdrawing conduit, which is used to draw or suck in the yarn end, thus providing for reconnecting it to the staple band internally of the rotor.

At present, this operation is carried out either manually or automatically. Generally, automatic reattachment is done by a sort of "robot" or apparatus moving along one or even more spinning frames for effecting reattachment operation to a spinning unit which has been stopped due to yarn breakage.

The movements effected by these devices are comparable with manual gestures. Of course, this concept would lead to an extremely complex apparatus, involving an investment of difficult amortization. Particularly, this is why commercially available devices have not been as successful as imaginable since many manufacturers deem such devices as scarcely competitive.

The present invention is directed to at least partly overcome the disadvantages in the above mentioned devices, by simplifying the construction and operation thereof.

To this end, the present invention is directed to a device for reinserting the yarn in a spinning unit of an open end type of spinning frame, comprising a member for releasing or disengaging the bobbin from its associated driving shaft, means for extracting the broken end of the yarn from bobbin, a yarn gripping element, a device for reinserting the yarn in the spinning unit, means for transferring said gripping element from a yarn gripping position to the reinserting device, and a yarn cutter adjacent said reinserting device; said transferring means comprising an endless belt having said gripping element attached thereto, guide means for this endless belt to form a loop passing in front of said yarn gripping position and in front of said reinserting device, driving means to cause the belt to move said gripping element from said yarn gripping position to said reinserting device, and means for stopping the belt at least one determined position in the path of said gripping element.

According to a first embodiment, the yarn reinserting device is an integral part of each spinning unit in an open end spinning frame, wherein the transferring means for the yarn gripping element also comprise the member for disengaging bobbin from the driving shaft.

According to a further embodiment, in order that a same device may serve several spinning units, and in case even many spinning frames, since the average rate of breakages depending on whether the silver more or less clean can be comparatively low, it is provided that at least the endless belt for transferring said yarn gripping member, as well as means for extracting the broken yarn end, are mounted on a carriage moving along rails parallel to a set of spinning units, said extraction means comprising an element for separating the end of the broken yarn from the bobbin, a drawing element for unwinding a yarn length from the bobbin and a guide element for guiding a portion of said yarn length to a zone of the path of a yarn gripping element attached to said endless belt, a cam being positioned in said path to "open" the jaws of the yarn gripping element at the time of its passage in said path zone to cause said jaws to pass from either side of said yarn length portion, and then close the jaws again on the yarn.

The accompanying drawings diagrammatically show by way of example some embodiments of the device according to the invention. In the drawings.

Figure 1:
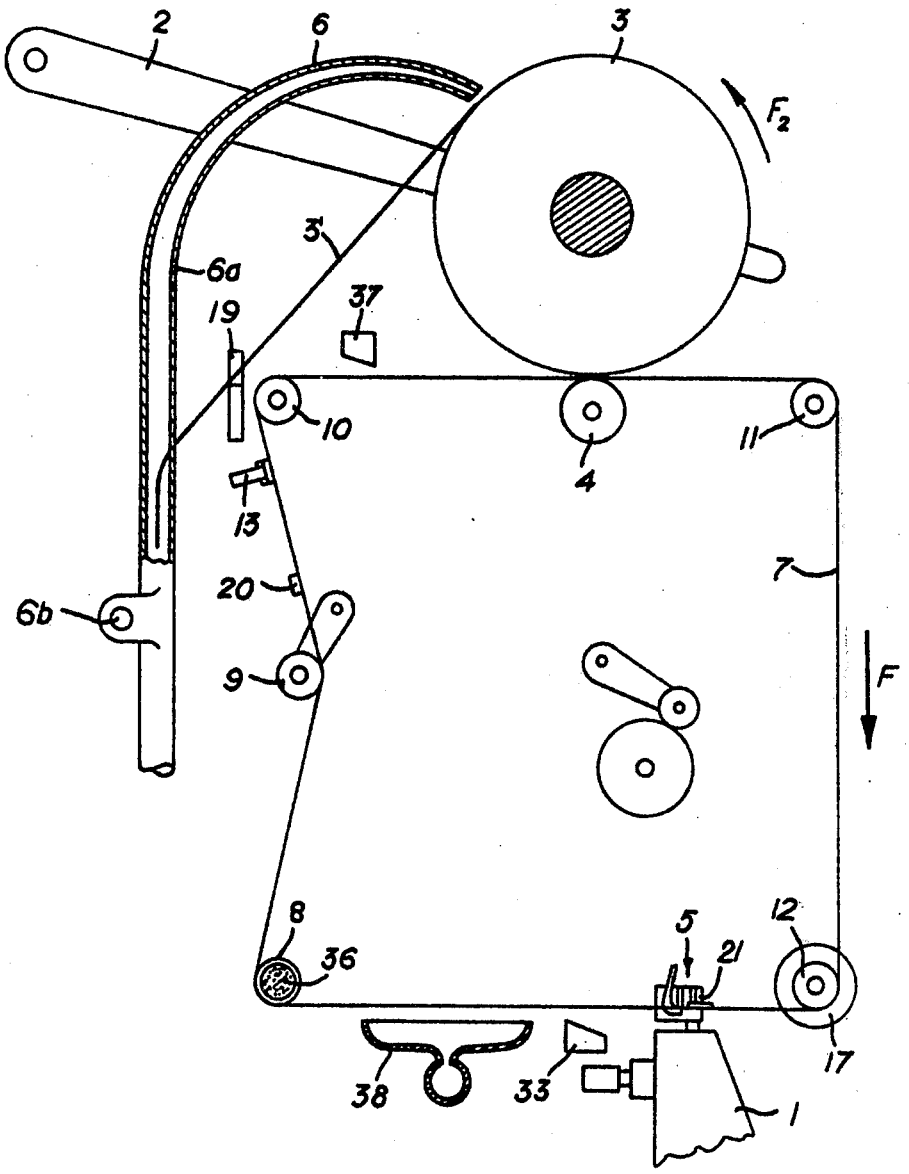
FIG. 1 is a side elevational view showing the device as mounted on a spinning unit of an open end spinning frame.

FIG. 1 shows the outlet of a rotor spinning unit 1 in an open end spinning frame. An arm 2 carries a yarn bobbin 3, which is normally rotably driven by a shaft 4 and intended for winding up of yarn 3' produced by unit 1.

The outlet of unit 1 carries a yarn reinserting device 5, to be described in the following. A pneumatic member 6 for extractint the broken yarn end is associated with said bobbin 3.

Figure 2:
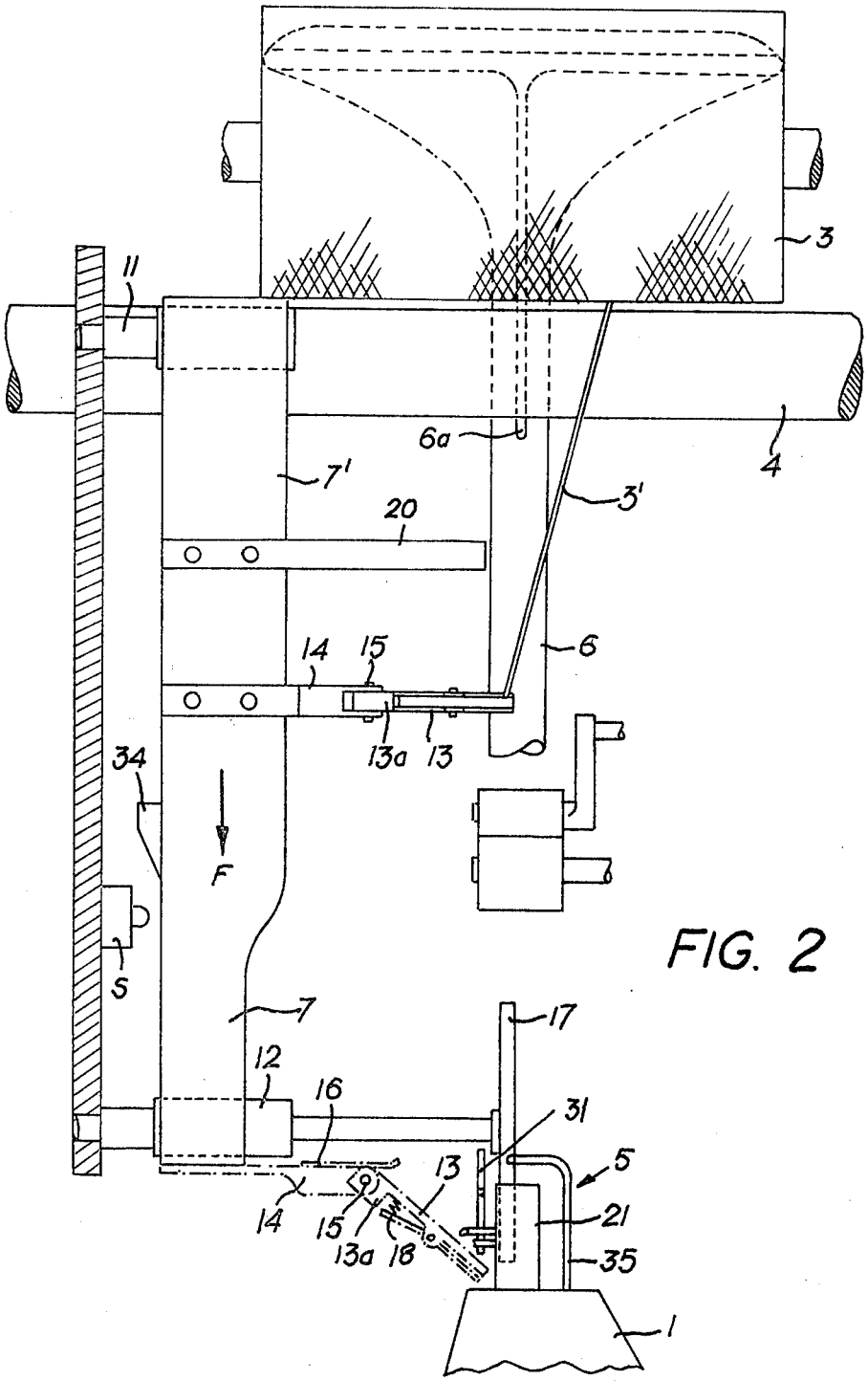
FIG. 2 is a front elevational view of FIG. 1.

A transfer belt 7 is entrained about five rollers 8, 9, 10, 11 and 12, of which roller 8 is the drive roller and roller 9 is the stretcher roller. Said belt 7 carries a gripping element for the yarn, in this example comprising pliers 13 for gripping the yarn. As shown in FIG. 2, the belt comprises a narrow section and a wider section of predetermined length for inserting between shaft 4 and bobbin 3 to disengage or release the latter from shaft 4. Transfer belt 7 performs the function of moving pliers 13 from a yarn gripping position to a device 5 for reinserting said yarn in spinning unit 1.

Figure 3:
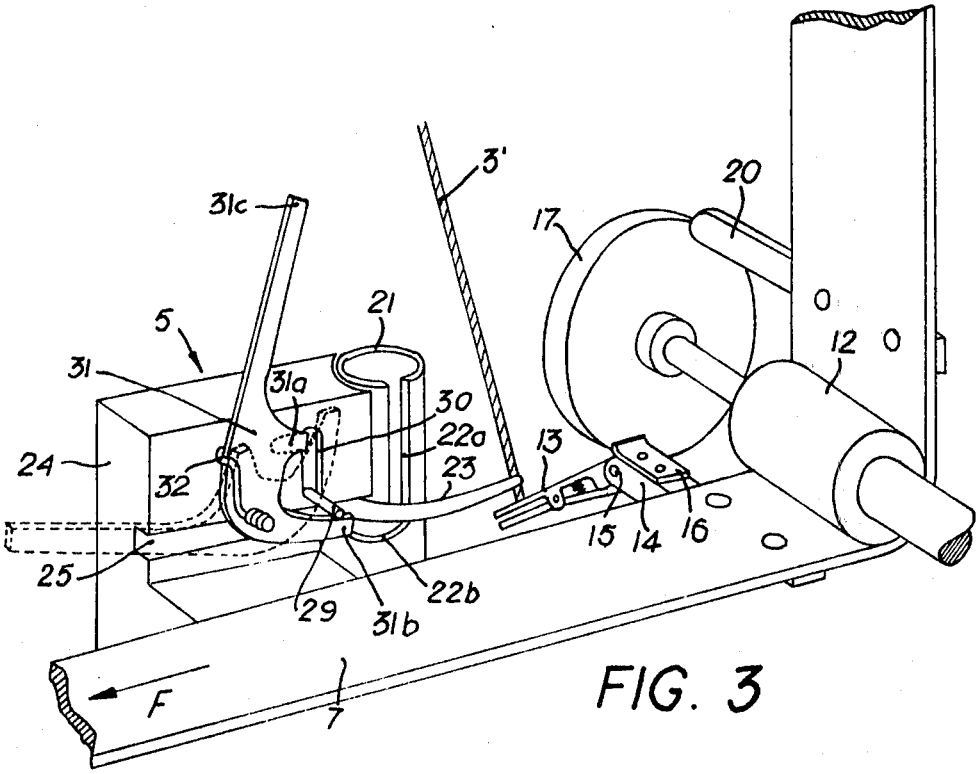
FIG. 3 is an enlarged perspective view showing a detail of FIG. 1.

Referring to FIGS. 2 and 3, it will be seen that one jaw of pliers 13 has a rear heel 13*a* linked to the end of an arm 14 integral with belt 7, to enable said pliers 13 to rotate about an axis 15 parallel to the edge of said belt.

This arm 14 carries a flat spring 16 bearing against said heel 13*a* of pliers 13. As shown in these FIGURES, pliers 13 are suitable to take or occupy two determined angular positions about axis 15, which positions are defined by two adjacent sides of heel 13*a*, intended to cooperate with spring 16. At one of these positions, pliers 13 are aligned with arm 14, and at the other position said pliers 13 form an angle with arm 14.

The movement of pliers 13 from said first to said second position is provided by means of a disc-shaped cam 17 concentric with roller 12. The reverse upsetting of these pliers is provided by a second cam 37 (FIG. 1), also positioned in the path of pliers 13; the two jaws of these pliers are urged against each other by a spring 18.

A third cam 19 (FIG. 1) is positioned in the path of the turned over pliers 13 to move its jaws away from each other against the pressure of spring 18, as the pliers intersect the yarn 3' stretched between bobbin 3 and the bottom of groove 6*a* in the extraction member 6 for the yarn from the said bobbin. The inner side or face of one of the jaws of said pliers 13 carries in juxaposed relationship a knife and a clamping pad (not shown) respectively for cutting a predetermined amount of yarn and holding the end of the yarn wind up on said bobbin 3 on pliers closing.

When considering the moving directions of the belt as shown by arrow F, it will be seen that pliers 13 is followed by a peg 20, the function of which will be explained hereinafter.

The extraction member 6 for yarn 3' (FIG. 1) is of a conventional design and comprises a tube having a curved and flattened end to extend throughout the length of bobbin 3. This tube 6 is connected to a suction supply (not shown) and has a longitudinal slit 6*a*. This tube is articulated about an axis 6*b*, enabling it to accomodate the diameter of said bobbin 3.

The yarn reinserting device 5, diagrammatically shown in FIG. 3, is located adjacent the horizontal run of belt 7 extending from roller 12 to roller 8. The actual reinserting device comprises a tube 21 located at the outlet of the spinning chamber, on the wall of which a longitudinal slit 22*a* is provided, starting from the end of the tube to continue with an arcuate slit 22*b* extending through about 90° around said tube 21. An arcuate arm 23 is secured to tube 21. This arm follows the upper edge of slit 22*b* and moves away from the tube starting from the intersection of slits 22*a* and 22*b* to extend in the direction of belt 7.

Figure 4:
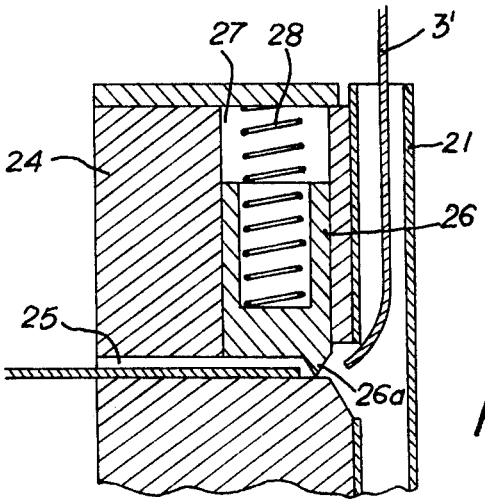
FIG. 4 is a sectional view of the reinserting device shown in FIG. 3 and yarn cutting device.

Tube 21 carries a block 24 comprising, parallel to belt 7, a yarn guide groove 25 defining a passage communicating with the slit of tube 21; a cutting member 26 for yarn 3' (FIG. 4), comprising a cylinder provided with a knife 26*a*, is mounted within a housing 27 of block 24 and urged by a spring 28 exerting a pressure in the direction of said yarn guide groove 25. This cylinder is integral with a peg 29 (FIG. 3) projecting outwardly of block 24 through a L-shaped slit 30. An arcuate lever 31 is linked to block 24, and urged by a return spring 32 tending to retain it at the position shown by full lines in FIG. 3.

Lever 31 is effective "to charge or load" said yarn cutting member 26 and has a first arm 31*b* acting on peg 29 to move the same along slit 30 when said lever 31 is rotated in counterclockwise direction, as seen in FIG. 3, under the action of a peg 20 driven by belt 7 operating against arm 31*c* of lever 31 to rotate the latter from the position shown by full lines to the position as outlined in FIG. 3.

A conventional breakage detector 35 (FIG. 2) is designed to stop the spinning rotor should the yarn break, as in all of the spinning frames of this type, as well as the beginning of the reinserting cycle of the broken yarn in the rotor.

Transfer belt 7 can also carry a small block 34 (FIG. 2) particularly suitable to control one or more switches S for causing said belt 7 to be stopped at the cycle end, as well as intermediate stops for the purposes that will be explained hereinafter, for carrying out the complete broken yarn reattachment cycle.

In the sliding direction of belt 7, block 24 is followed by an opening cam 33 for pliers 13, and also a suction inlet 38 for removing the cut away pieces of yarn.

Drive roller 8 is connected through an electromagnetic clutch (not shown) to a control shaft 36. When breakage detector 35 is operated by yarn breakage, it stops the rotor of spinning unit 1 and actuates the electromagnetic clutch for rotably connecting said roller 8 with control shaft 36. Then, transfer belt 7 forwardly moves in the direction of arrow F, so that the wider section of belt 7' is inserted between said yarn bobbin 3 and driving shaft 4. Bobbin 3, thus released or disengaged from shaft 4, can be drawn in the direction $F_2$ (FIG. 1) by belt 7 for yarn unwinding. At the same time, operation is started for the suction supply connected to yarn extraction conduit 6. When the end of the broken yarn passes in front of the end of conduit 6, it is sucked or drawn into this conduit. On further continued rotation of bobbin 3 in the direction of arrow $F_2$, a time is reached at which the yarn, as wound up with a reciprocating motion relative to the longitudinal axis of bobbin 3, passes in front of slit 6*a*. The yarn is then stretched between the bobbin and the end of slit 6*a*, at the position shown in FIG. 1.

At this time, pliers 13, that have been previously turned over to the cranked position as passing on disc 17 integral with the axis of roller 12 (FIG. 2), arrives on cam 19, moving its jaws away from each other, for the passage of the yarn therebetween, whereupon said jaws are closed again. A knife (not shown), integral with one of the jaws of the said pliers, provides for cutting the yarn which is sucked or drawn into tube 6, whereas a clamping pad grips the other end of the yarn between the pliers jaws closed by spring 18. On continued moving belt 7 in the direction of arrow F, pliers 13 would meet a cam 37 bringing them back to the extension of arm 14, thus enabling it to pass between said bobbin 3 and shaft 4. Prior to reaching said yarn reinserting device 5, pliers 13 are again turned over by disc 17.

Pliers passes then beneath thread guide arm 23, continuing to draw the yarn. Arm 23 holds the yarn, so that the drawing being exerted on the yarn by said pliers 13, the latter continuing to move forward, and the arcuate shape of arm 23, cause the yarn to progressively enter said tube 21 through slits 22*a* and 22*b*; at the outlet of slit 22*b*, the yarn is urged or pushed towards the guide groove 25, but cannot penetrate therein due to the lowered position of cutting member 26. At this time, peg 20 downstream of pliers 13 along belt 7, will encounter lever 31, causing it to turn over to the position shown by broken lines in FIG. 3, lifting pin 29 integral with cylinder 26 (FIG. 4), loading spring 28; the yarn will then penetrate into groove 25. When peg 20 leaves arm 31*c*, spring 32 urges lever 31 to the position shown by full lines. Owing to its heel 31*a*, this free lever strikes on and releases peg 29, so that cylinder 26 of knife 26*a* is lowered by spring 28. Knife 26*a* cuts the yarn by striking on the lower edge of guide groove 25.

Cam 33 (FIG. 1) then allows for opening said pliers 13 and the piece of cut yarn is sucked by suction inlet 38.

Due to suction exerted in reinserting tube 21 by the spinning rotor of spinning unit, which has been started by a switch (not shown), positioned at a determined location of the path travelled by said small block 34, the piece of yarn 3', which is unwound from bobbin 3 for a length section predetermined by the length of the wider portion 7' of belt 7, is sucked or drawn into the rotor, where reattachment is effected between this end and the fibers supplied to the rotor. At this time, the narrow portion of belt 7 is in front of bobbin 3, to allow the latter to rest on driving shaft 4. Another switch (not shown) is then operated by small block 34, stopping the cycle of undertaken operations to effect yarn reinsertion in the spinning unit, and stopping belt 7.

Figure 5:
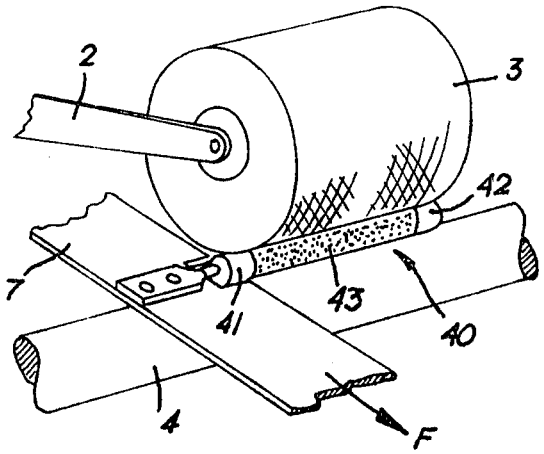
FIG. 5 is a perspective view showing a modified embodiment for the yarn extracting means and gripping element.
Figure 6:
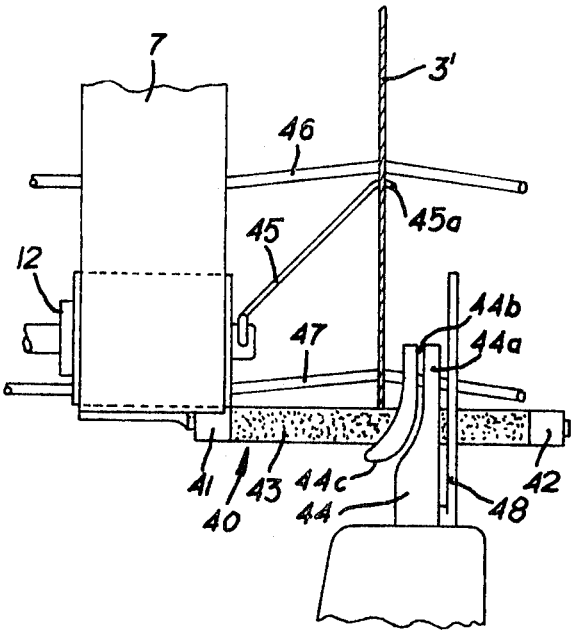
FIG. 6 is a fragmentary front elevational view of the embodiment of FIG. 5.

FIGS. 5 and 6 show a modification to the above described reinserting device. This modification essentially differs from the previously described embodiment by using another yarn extraction device from bobbin 3 and drawing member; particularly, this other device comprises a roller 40 idely rotably mounted about an axis extending laterally of said transfer belt 7. At its ends, this roller 40 comprises two rubber bands 41 and 42, between which a "Velcro" type of hook fabric tape or band 43 is glued, the width of this tape or band being the same as that of bobbin 3. Said rubber bands 41 and 42 have an outer diameter substantially at flush with the hooks of fabric 43.

The operation of this yarn extractor is as follows. At the time when roller 40, driven by belt 7 in the direction of arrow F, encounters the winding up bobbin 3, it lefts the latter interposing between driving shaft 4 and the bobbin itself. Due to said rubber bands 41 and 42, the friction between said shaft 4 and roller 40 is sufficient for rotably driving the latter. As a result, the direction of rotation for bobbin 3 is reversed and the bobbin rotates in the yarn unwinding direction. When the end of broken yarn passes on roller 40, the fabric hooks 43 will grip said end and start to wind it up. It is understood that during this step said transfer belt 7 is stationary, its stop having been provided, as above stated, by a switch (not shown) located adjacent the belt and driven by small block 34 integral with the latter. This switch may be a time switch returning to its initial position at the end of a determined period, for allowing to wind up a minimum amount of yarn intended to be later removed. It is known that upon occurrence of yarn breakage, some possible defective length of yarn is generally removed, because of having caused the yarn breakage.

Figure 7:
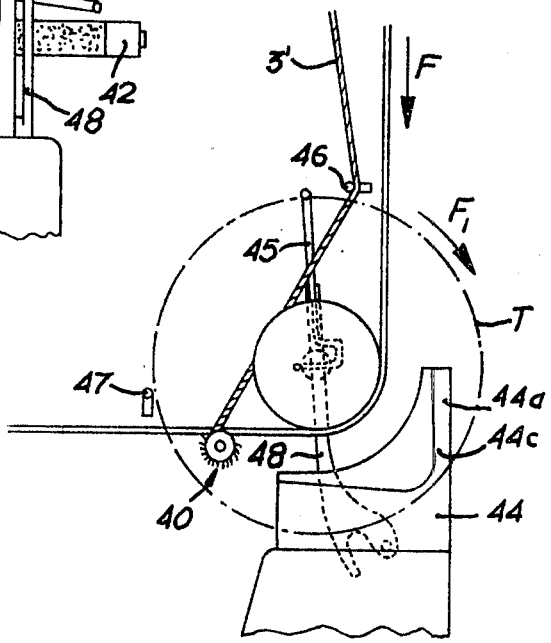
FIG. 7 is a side elevational view of FIG. 6.

The use of this yarn extraction member 40 requires some modifications to the reinserting device shown in FIGS. 6 and 7. As the extraction member extends throughout the width of bobbin 3 to grip the end of broken yarn, where the latter is on the bobbin, in this example said member 40 is made not to pass by yarn reinserting device 44. Thus, the path of member 40 would otherwise intersect the reinserting tube 44*a* of device 44. Since the yarn does no longer pass at right angles adjacent slit 44*b* of tube 44*a*, provision is made for an arm 45 secured to roller 12 so as to rotate therewith. This arm 45 terminates with a hook 45*a*.

Two stationary V-shaped guides 46 and 47 are positioned on either side of roller 12 close to the sections of belt 7 extending from one to the other side of roller 12. The inside corner of these guides lie on the plane of the path described by the rotation of hook 45*a* about the axis of roller 12. Tube 44*a* of yarn reinserting device 44 comprises a cam 44*c* crossing the plane of the circular path T described by said hook 45*a*. As in the case of the preceding embodiment, said reinserting device 44 comprises a yarn cutter lever 48 operating according to a principle similar to the yarn cutter illustrated in FIG. 4, and which will not be further described in this modification.

As roller 40 passes about roller 12, arm 45 is at any angular position about the axis of this roller. The yarn then bears on guide 46. The tension exerted on the yarn by moving roller 40, carries said yarn into the loop as formed by the crank of guide 46 (FIG. 6). As roller 40 forward moves in the direction of arrow F, the yarn is stretched between guide 46 and said roller, forming a stright line until the yarn encounters second stationary guide 47. Thus, the yarn encounters said second guide 47 only if in its rotation said arm 45 has not yet encountered the yarn. When, on turning in the direction of arrow $F_1$ (FIG. 7), hook 45*a* of arm 45 passes close to guide 46, it grips the yarn and moves it away from guide or guides 46 and 47. As path T of hook 45*a* passes beyond cam 44*c*, the hook engages the yarn on said cam 44*c* and progressively releases the yarn as pulled at one side by bobbin 3 and at the other side by roller 40. This tension causes the yarn to penetrate into slit 44*b* of reinserting member 44.

On passing about roller 12, roller 40 turns over the lever 48 of said yarn cutter. The length of said lever is selected so that roller 40 will release it only when the yarn has been introduced into device 44. As yarn introduction time depends on the angular position of arm 45 at the time of roller passage, it will be arranged that lever 48 is released taking into account the supposition that the longest delay between the intersection of roller 40 with the path of arm 45 and the encounter of the latter and yarn is reversed, so as to assure that said yarn cutter actually cuts the yarn and does not fall down before the yarn has been inserted in said device 44.

Since the cycle is not terminated at this time, it should be added that in the next or following said arm 45 does not encounter any longer the yarn, as the latter has been shifted from path T due to ramp or cam 44*c* of device 44.

FIGS. 8 to 12 shown a further modification.

Figure 8:
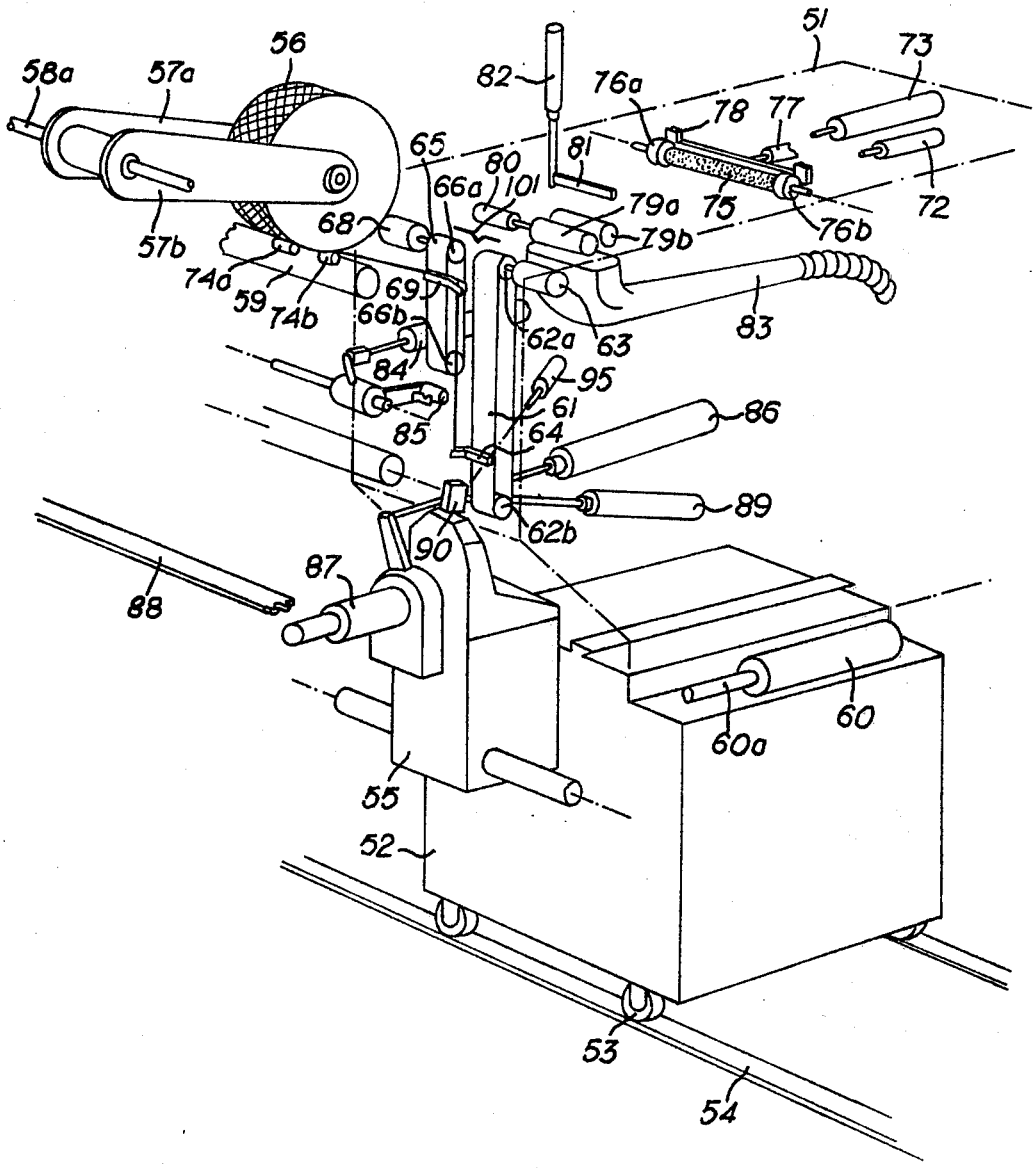
FIG. 8 is a diagrammatic perspective view of a further modified embodiment of the device according to the invention.

By dashed lines, FIG. 8 shows a carriage 51 slidably mounted on a base 52 provided with sliding wheels 53 meshing with a rail 54 integral with the framework (not shown) of the spinning frame. Said rail 54 extends parallel to a row of spinning units 55, of which only one is shown in this FIGURE, with its associated yarn winding up bobbin 55 carried between two arms 57*a* and 57*b* articulated about an axis 58. Said bobbin 56 bears on a driving shaft 59.

The sliding direction of carriage 51 is transverse to said rail 54. Stem 60*a* of a jack integral with base 52 is connected with said carriage 51 for sliding the latter relative to said base 52.

The reinserting device assembly is carried by carriage 51, and comprises a transfer or dump mechanism including a first endless belt 61 stretched between two rollers 62*a* and 62*b*, of which said roller 62*a* is integral with the shaft of a motor 63. Said first endless belt 61 carries pliers 64, to be described in more detail hereinafter. A second endless belt 65, which is shorter than said first endless belt, is stretched between two rollers 66*a* and 66*b*, of which said roller 66*a* is integral with the shaft of a motor 68 coaxial with the shaft of said motor 63. Said second belt 65 also carries pliers 69, shown in detail in FIG. 5.

Figure 9:
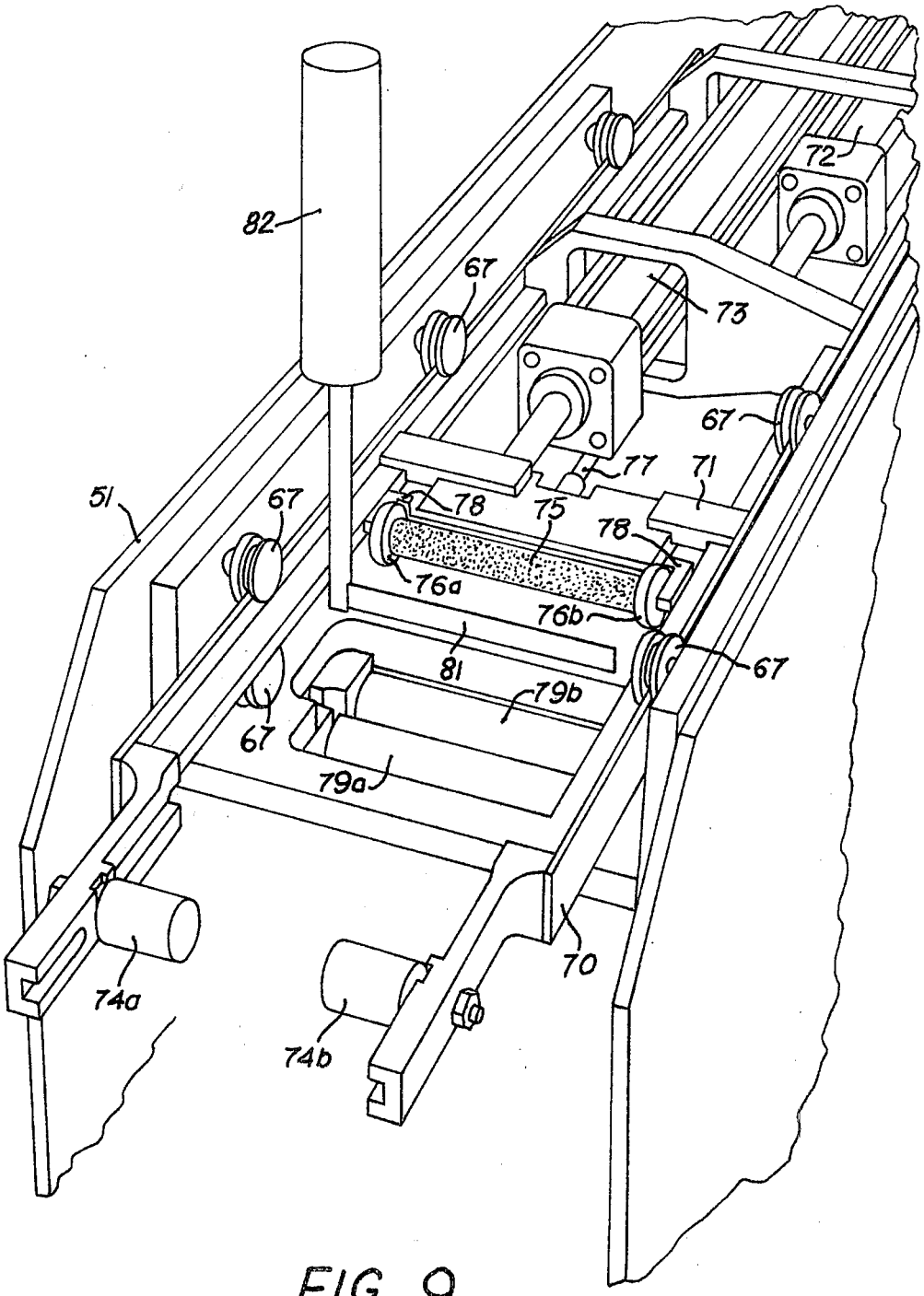
FIGS. 9 to 12 are enlarged perspective views showing some details of FIG. 8.

This device further comprises a mechanism for releasing or disengaging said bobbin 56, and a mechanism for extracting the broken yarn end on bobbin 56. The detail of these mechanisms is shown in FIG. 9, depicting two telescopic slides 70 and 71, operated by two jacks 72 and 73, respectively. Said slide 70 is mounted on carriage 51 between wheels 67 defining a sliding path parallel to the moving direction of carriage 51 relative to base 52, and carries at its front end two freely rotable coaxial rollers 74*a* and 74*b*. Said second slide 71 is mounted within said first slide 70 and carries at its front end a roller 75 transverse to the slide and free to rotate about the axis thereof, said roller 75 being coated with a hook fabric, commercially referred to as "Velcro" and being effective to grip the yarn. Two rubber wheels 76*a* and 76*b* are secured to the ends of roller 75. The spacing between said wheels 76*a* and 76*b* is larger than the width of bobbin 56. The diameter thereof is larger than that of roller 75 as measured on the most projecting parts of the hook fabric covering it, so that at time of interposing roller 75 between said cylinder 59 and bobbin 56, as explained in the following, wheels 75*a* and 75*b* are frictionally drawn against the rotating shaft 59, while the bobbin bears or rests on that portion of gripping roller 75 which is covered by the hook fabric.

Slide 71 also carries a jack 77, the stem of which is secured to a brake 78 intended to bear against said rubber wheels 76*a* and 76*b* to prevent said roller 75 from rotating.

Said slides are mounted on a plane substantially passing between said bobbin 56 and its associated operating shaft 59. A pair of rollers 79*a* and 79*b* are mounted on said slides 70 and 71, of which one roller 79*a* is integral with the shaft of an operating motor 80 (FIG. 1). An arm 81, parallel to the nipping line of said two rollers 79*a* and 79*b*, extends at right angles to the stem of a jack 82 (FIG. 1), vertically secured to said carriage 51. At the position shown, said arm 81 is above slides 70 and 71.

A suction inlet 83, positioned beneath rollers 79*a* and 79*b*, is connected to a suction supply, not shown.

Carriage 51 also carries a jack 84 for operating a yarn extraction roller 85 located between said spinning unit 55 and winding up bobbin 56, and a jack 86 for disengaging or releasing a shaft 87 for the rotor of said spinning unit 55 of the spinning frame operating belt 88. The steam of a jack 89 carries a device 90 comprising the yarn reinserting device in said spinning unit 55, intended to be positioned at advanced position of the stem of said jack 89 on said spinning unit 55. This device 90 is more particularly shown in FIGS. 10 and 11 and it is conceived similarly to the reinserting device shown in FIG. 3 as previously described.

The essential difference between device 90 and device 5 of FIGS. 1 to 3 is in that device 90 is made of two pieces or elements 90*a* and 90*b* pivoted about a hinge 91 and resiliently maintained against each other by a spring 92. The underside of said device 90 has an opening 93 located at either side of the joining line of said two parts or elements 90*a* and 90*b*, and is intended to accomodate a connecting tube (not shown) integral with said spinning unit 55, comprising the opening through which the yarn being produced by unit 55 emerges in the direction of spool 56. Said two parts or elements 90*a* and 90*b* of device 90 have at the bottom of the sides thereof opposite to hinge 91 a slit 94 of right triangular cross-section, wherein one of the corners coincides with said joining line of said two parts or elements 90*a* and 90*b*. Said slit 94 is designed for side introduction of said connecting tube of unit 55 into said opening 93, causing by wedging action said two parts or elements 90*a* and 90*b* to move away from each other, and then close on said tube due to spring 92, thus allowing to use the simple jack 89 to engage and disengage the reinserting device from said spinning unit 55; the drop shape given to the right section of opening 93 again causes two parts or elements 90*a* and 90*b* of reinserting device 90 to move away from each other, when the stem of jack 89 is retracted.

Said opening 93 is coaxial with a vertical yarn guide groove 99, and communicates therewith. A very thin rubber lip 102 covers said groove 99 for a purpose to be explained in the following.

A thread cutter 95 is also secured to the part or element 90*a* of reinserting device 90. Said thread cutter comprises a jack secured to device 90 and the stem of which (not shown) engages in a passage 96 formed in said part or element 90*a*. Said passage 96 perpendicularly cuts a passage 97 located just below a horizontal yarn guide groove 98, of which one end is adjacent said vertical groove 99. When the yarn has been placed in said grooves 98 and 99, it is cut at the time the stem of jack 95 penetrates into said passage 97. Simultaneously, the stem of jack 95 provides for separating groove 99 from groove 98 for a purpose to be described hereinafter.

A yarn hooking and guiding element 100, extending laterally and outwardly of said reinserting device 90, has its origin at the joining location of said horizontal and vertical grooves 98 and 99, respectively. Said yarn hooking element 100 is within the loop described by pliers 64 (FIG. 8), operated by endless belt 61, adjacent the lower end of this loop, to hook the yarn upon the passage of pliers 64. Said hooking element 100 is configurated so that the traction exerted on the yarn by the upward movement of pliers 64, after the passage thereof about said element 100, causes the yarn to slip into grooves 98 and 99 of said device 90.

Figure 12:
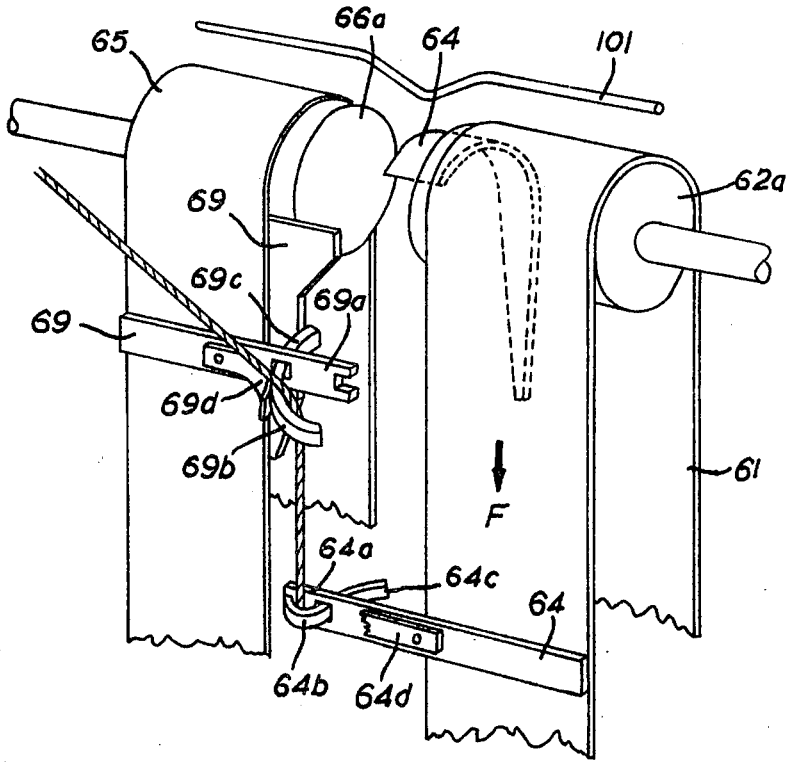

The details of pliers 64 and 69, which are identical to one another, are shown on enlarged scale in FIG. 12. Said pliers 64 and 69 respectively comprise a stationary jaw 64*a*, 69*a* secured to the associated belts 61 and 65, a jaw 64*b*, 69*b* pivoted to the stationary jaw and extending by means of a spur-like member 64*c*, 69*c*, and a spring 64*d*, 69*d* integral with said stationary jaw 64*a*, 69*a*, and urging said movable jaw 64*b*, 69*b* to a pinching position. Cams 64' and 69' extend laterally along the respective belts 61 and 65 and are intended to act upon said spur-like members 64*c* and 69*c*, respectively, of said movable jaws 64*b* and 69*b* to move said movable jaws away from the stationary jaws.

An operating cycle of the described device will now be explained, with the aid of the operating diagram of FIG. 13, wherein position I defines the rest or inoperative state for each of the members, and position 11 defines the operational state of said members. Assume that upon yarn breakage, said base 52 is moved to an accurately defined position in front of spinning unit 55, the known breakage detector of which (not shown) has signalled the yarn breakage by any suitable means, such as optical means.

Figure 13:
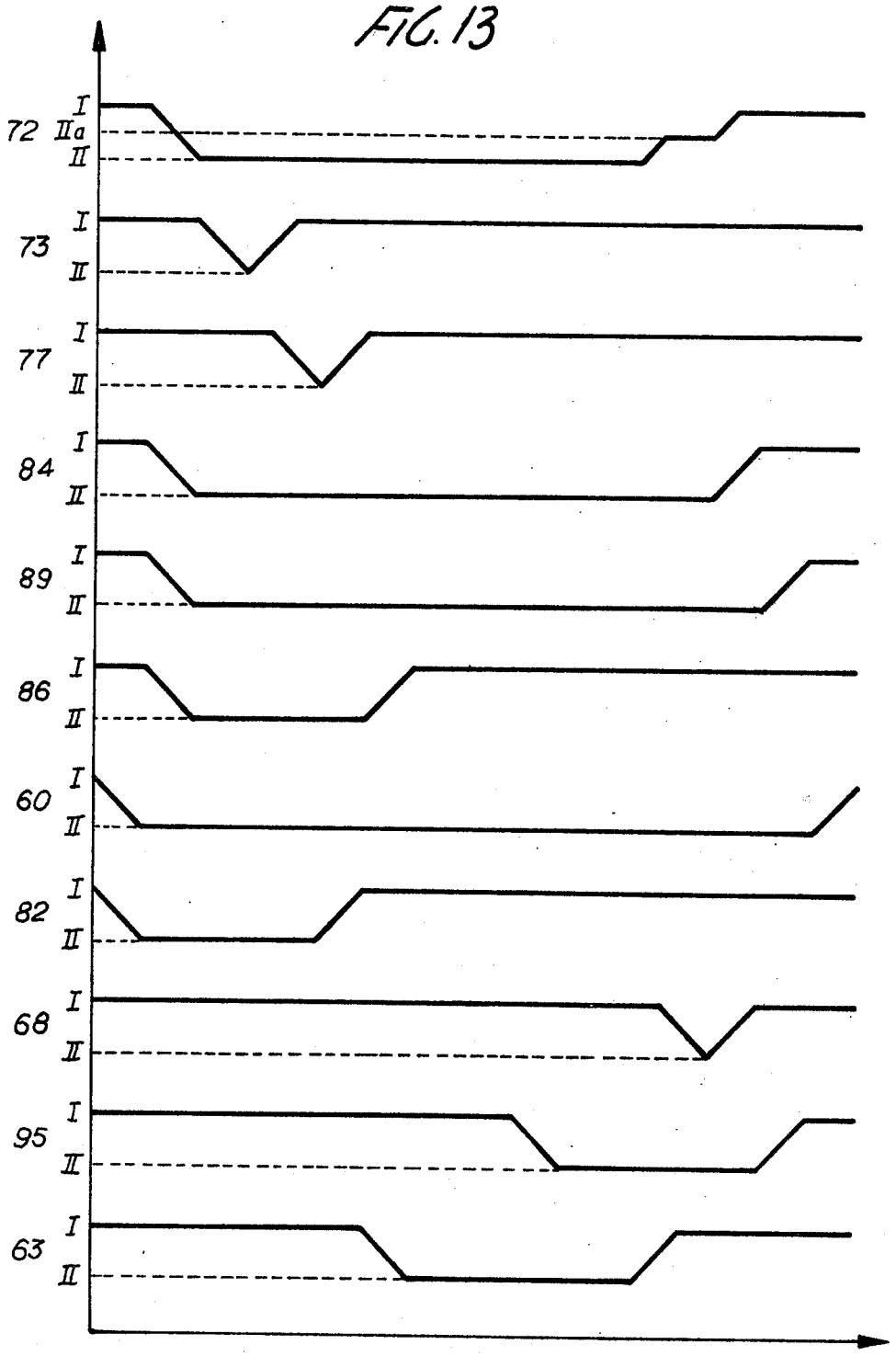
FIG. 13 is an operation diagram for the control of the device shown in FIG. 8.

As soon as the device is positioned, the cycle begins and the various device operating members are actuated according to the chronological sequence set in the diagram of FIG. 13. Firstly, the stem of jack 60 urges carriage 51 to said spinning unit 55. At the same time, jack 82 lifts arm 81.

Four jacks are then simultaneously operated, i.e. jack 84 for moving away extraction roller 85, jack 86 for disengaging the rotor operating shaft 87 of unit 55 of driving belt 38, jack 89, the stem of which carries said yarn reinserting device 90, which is then connected to the above mentioned tube located on spinning unit 55, and finally jack 72 for feeding slide 70 to bobbin 56. This bobbin 56 is lifted and separated from operating shaft 59 when encountered by wheels 74*a* and 74*b*. Said bobbin 56 is then stationary, while being free to rotate, due to the fact that said wheels 74*a* and 74*b* are idle and never contact said shaft 59.

Next, jack 73 is operated in turn to forwardly urge slide 71 and bring roller 75 between said bobbin 56 and shaft 59. Rubber wheels 76*a* and 76*b* are then driven by shaft 59. Accordingly, the bobbin bearing on the roller portion covered with hook fabric is driven in turn, but in opposite direction to the driving direction of shaft 59, that is in the yarn unwinding direction. The fabric hooks quickly extract the broken yarn end which unwinding from bobbin 56 will wind up on roller 75.

Jack 73 is then retracted drawing said slide 71, and jack 77 then urges said brake 78 against rubber wheels 76*a* and 76*b*, preventing roller 75 from rotating as slide 71 is retracted. Accordingly, this retraction movement of roller 75 rotates said bobbin 56 on wheels 74*a* and 74*b*, unwinding the yarn. When the roller is again at the position shown, brake 78 releases said wheels 76*a* and 76*b*. The yarn, as stretched between said bobbin 56 and roller 75, passes above rollers 79*a* and 79*b* which are driven by motor 80 throughout the cycle.

Arm 81 is then lowered by the stem of jack 82 until it inserts between rollers 79*a* and 79*b*. Since during its downward travel or stroke said arm encounters the stretched yarn, it will provide for inserting it between rollers 79*a* and 79*b*, the latter drawing it in the direction of suction inlet 83, thus unwinding the yarn from roller 75. On downward movement, the yarn being unwound from the bobbin will encounter a guide 101 (FIGS. 8 and 12) located between said two belts 61 and 65 and is V-shaped as centered on the centerline of the space separating said two belts and has the purpose of sidewise positioning the yarn.

Figure 10:
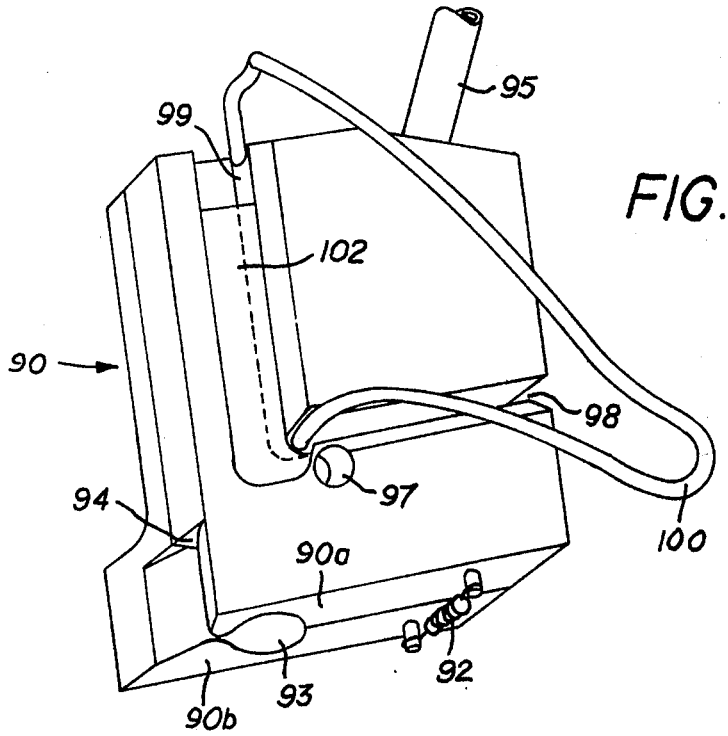
Figure 11:
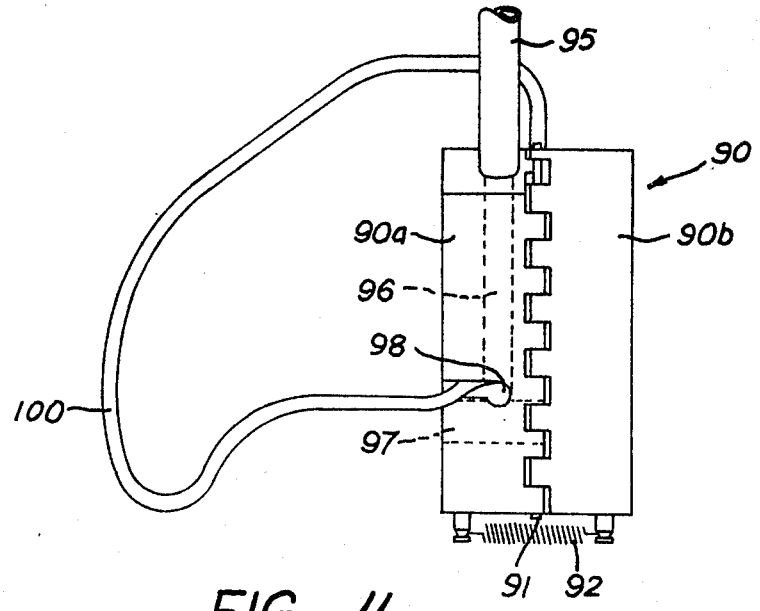

Motor 63 is then operated, driving said belt 61 in the direction of arrow F. Pliers 64 is then on the rising run of the belt, and not on the descending run, as shown in FIG. 10. As the pliers approaches the top of the path thereof, said cam 64'moves said movable jaw 64*b* away from said stationary jaw 64*a*, acting upon said spur-like member 64*c*. When the pliers reaches the top of the path thereof, its spread apart jaws pass from one to the other side of the yarn and abruptly close on said yarn, leaving said cam 64'at the time said pliers starts the downward movement thereof. Said pliers 64 may have a knife (not shown) for separating the yarn of the portion retained between rollers 79*a* and 79*b*. This separation could be also carried out by a simple traction exerted on the yarn.

On downward moving, said pliers 64 passes between the open jaws of pliers 69, the latter being stationary at the position shown in FIG. 12. When pliers 64 passes about roller 62*a*, the path thereof encircles the hooking element 100 of device 90 (FIGS. 3 and 4) hooking the yarn, so that on upward moving said pliers exerts a traction on the yarn retained by said element 100, causing it to slide along said hooking element 100 until entering said grooves 99 and 98 of reinserting device 90. Upon passing, the yarn removes said rubber lip 102, which is then closed.

As soon as motor 63 is energized, the stem of jack 86 is retracted, rotating the rotor to generate a vacuum within said spinning unit 55.

Upward movement of pliers 64 coincides with operation of thread cutter 95. As the inside of spinning unit 55 is under vacuum and vertical groove 99 communicates with the outlet conduit of said unit 55, a traction is exerted due to suction on the cut yarn at the joining location of grooves 98 and 99. The reason because groove 99 is laterally closed by lip 102 and at the same time thread cutter 95 is engaged in opening 97, is due to the necessity of maximizing canalization of air sucked by spinning unit 55 in groove 99, in order to pull the yarn in the direction of unit 55.

At this time, jack 72 slightly retracts slide 70 to position IIa (FIG. 13), but not sufficiently that bobbin 56 contacts again said cylinder 59. This retraction movement is for unwinding some length of yarn of bobbin 56, so that the cut end of the yarn can further move downward and penetrate into the outlet conduit of unit 55 owing to the communication existing between groove 99 and said unit, through opening 93 of device 90.

At this time, motor 68 is energized to drive endless belt 65, the pliers 69 of which stops leaving cam 69'. As the yarn passed between the jaws of pliers 69 (FIG. 5), some length of yarn is still unwound from bobbin 56. This length is selected for introduction of yarn to within the spinning rotor of unit 55 and the stroke or run of motor 68 is immediately reversed to extract the yarn reattached at the precise instant slide 70 is completely retracted by jack 72, contacting bobbin 56 with driving shaft 59. At the same time, the stem of jack 84 is retracted and pliers 69 close and draw the yarn therewith. On upward moving, pliers 69 encounters again said cam 69'and open. Cam 69'has a portion moving to a larger extent away from the edge of belt 65 and performs the function of moving away to a larger extent the jaws of pliers 69 for releasing the yarn.

The cycle is then terminated and jack 60 can move the carriage 51 back to place it in front of another spinning unit 55 for a further reattachment of the yarn by means of a cycle identical to that jack described.

What is claimed is:

1. A device for reinserting the broken yarn in a spinning unit of an open end type of spinning frame, comprising a disengaging or releasing member between the winding up bobbin and associated driving shaft, means for extracting the broken end of yarn from the bobbin yarn, a yarn gripping element, a device for reinserting the yarn in the spinning unit, means for transferring said gripping element from a yarn gripping position to said reinserting device and a thread cutter adjacent said reinserting device, said transfer means comprising an endless belt having said gripping element secured thereto, guide means for said endless belt to form a loop passing in front of said yarn gripping position and said reinserting device, driving means for said belt to move said gripping element from said yarn gripping position to said reinserting device, and means for stopping said belt at least at a determined position of the path of said gripping element.

2. A device according to claim 1, said device being comprised as integrating part of each of the spinning units in the spinning frame, and said endless belt supporting the yarn gripping element has a section of larger width for inserting between said driving shaft and yarn winding bobbin for disengaging or releasing the latter.

3. A device according to claim 1, in which said yarn reinserting device comprises a tube at the outlet end of the spinning chamber, on the wall of which a longitudinal slit is formed from the tube end and continues with an arcuate section extending around the tube; and an arcuate yarn guide arm extends along the arcuate section of said slit in the direction of the belt.

4. A device according to claim 1, in which said thread cutter comprises a block having a yarn guide groove parallel to the endless belt, and the latter has secured thereto a peg acting against a lever pivoted to said block to load said thread cutter.

5. A device according to claim 4, in which said lever is subjected to the action of a return spring and has a heel striking a releasing peg for said thread cutter.

6. A device according to claim 1, in which said gripping element comprises pliers pivoted to said endless belt, and two cam means are provided along the path of the latter to turn over the yarn gripping pliers.

7. A device according to claim 1, in which the yarn extraction means comprise a roller idly rotably carried by an axis projecting from said endless belt, and that said roller has a coating of hook fabric for yarn gripping, and rubber bands at its ends of outer diameter substantially flush with the ends of the fabric hooks.

8. A device according to claim 7, in which along the path of said endless belt said yarn gripping roller is effective on the operating lever of said thread cutter.

9. A device according to claim 7, in which a rotating arm is provided at said yarn reinserting device, terminating with hook-shaped end, and stationary V-shaped guides, the inside corner of which lies on the plane of the path described by the hook.

10. A device according to claim 1, in which at least the endless belt and said guide means, and said means for extracting the broken end from bobbin are mounted on a carriage moving along a sliding rail parallel to a set of spinning units, said extraction means comprising an element for separating the end of the broken yarn from the bobbin, a traction element for unwinding a length of said yarn from the bobbin, and a guide element for moving a portion of said yarn length to a zone of the path of pliers integral with said endless belt; a cam being positioned in said path to move away the pliers jaws at the time of its passage in said zone to pass the jaws from one to the other side of said yarn length and close said jaws on said yarn.

11. A device according to claim 10 comprising in addition to said first endless belt a second laterally positioned endless belt having pliers projecting to said first endless belt.

12. A device according to claim 11, in which said endless belts are controlled by independent electric motors.

13. A device according to claim 11, in which said carriage comprises first and second slides movable transversely of the carriage sliding rails, said first slide carrying a pair of coaxial rollers insertable between the yarn winding up bobbin and driving shaft, and the second slide carries at its end said yarn extraction device.

14. A device according to claim 13, in which said yarn extraction device comprises a roller coated with a hook fabric and has at its ends friction wheels of a larger diameter than the roller and having a spacing larger than the width of the yarn bobbin.

15. A device according to claim 14, in which said second slide carries a brake for the yarn extraction roller.

16. A device according to claim 11, in which said reinserting device is movable on the carriage and is made of two pieces articulated to each other and resiliently urged against each other.

17. A device according to claim 16, in which said yarn reinserting device has a first groove which is vertical or parallel to the endless belt, and a second horizontal groove communicating with said first groove; a yarn hooking and guiding element sidewise positioned from the groove starting location, and a lower yarn passage opening communicating with said vertical groove.

* * * * *